United States Patent [19]

Polanschütz et al.

[11] Patent Number: 4,909,306

[45] Date of Patent: Mar. 20, 1990

[54] STIRRING PROVISION FOR A CONTINUOUS CASTING PLANT

[75] Inventors: Wolfgang Polanschütz; Luzian Pochmarski; Alfred Moser, all of Leoben, Austria

[73] Assignee: Voest-Alpine International Corporation, New York, N.Y.

[21] Appl. No.: 662,719

[22] Filed: Oct. 19, 1984

[30] Foreign Application Priority Data

Nov. 4, 1983 [AT] Austria ..... 3896/83

[51] Int. Cl.[4] ..... B22D 27/02

[52] U.S. Cl. ..... 164/468; 164/504

[58] Field of Search ..... 164/468, 504, 502, 466, 164/498, 499, 147.1

[56] References Cited

U.S. PATENT DOCUMENTS 4,244,419 1/1981 von Starck et al. ..... 164/468 X

FOREIGN PATENT DOCUMENTS 28761 5/1981 European Pat. Off. ..... 164/468
1962341 6/1971 France .
2756623A 6/1979 France .
2930281 2/1980 France .
54-37086 11/1979 Japan ..... 164/504

*Primary Examiner*—Kuang Y. Lin
*Attorney, Agent, or Firm*—Horst M. Kasper

[57] ABSTRACT

At least two magnetic induction elements operated with alternating current are disposed successively in the longitudinal direction at the guide for a strand of a continuous casting plant, and in particular for a continuous steel casting plant, to provide a stirring mechanism. Each induction element is connected to its own phase (R, S, T, N) of the at least two phase alternating current and the phases (R, S, T, N) are shifted with respect to each other by a phase angle of from about 0 to 180 degrees. In order to avoid the formation of a continously uniformly directed circulating current of metal despite a simple and sturdy stirring provision and without the presence of additional switching circuits, the phases (R,S,T) generate in each case electromagnetic forces under formation of a magnetic alternating field at at least two neighboring induction elements, where the momentary value differences and the directional differences correspond to a phase shift of $\Phi+180$ degrees.

23 Claims, 2 Drawing Sheets

STIRRING PROVISION FOR A CONTINUOUS CASTING PLANT

BACKGROUND OF THE INVENTION

1. Field of the Invention

The present invention relates to a stirring provision for a continuous casting plant, and in particular to a continuous steel casting plant, where at least two magnetic induction elements are operated with alternating current and are disposed successively in the longitudinal direction of the guiding of the strand, where each induction element is connected to a proper phase of the at least two phase alternating current and where the phases are shifted with respect to each other by a phase angle Φ from about 0 to 180 degrees.

2. Brief Description of the Background of the Invention Including Prior Art

A stirring provision of the kind set forth above has been taught in German patent application Laid Out No. DE-A 2,756,623, where a continuous relative motion of the melt is achieved in the region of the stirring provision. This results in the disadvantage that inhomogeneities are created in the cross direction of the strand (white bands) by unsteady concentration changes, which, when used, interfere with the resulting properties of the strand.

The German Patent No. DE-B 1,962,341 teaches a stirring provision, which can achieve a discontinuous metal flow in the core zone of a strand for the avoidance of segregation and liquation. Travelling inductors are taught disposed successively in the longitudinal direction of the guide of the strand, where each inductor is bar-wound. A multi-phase sinusoidal electrical voltage generates an electrical travelling field formed as a wave progressing in the longitudinal direction of the travelling field inductors. The travelling field inductors are either alternatingly switched on and off or are changed in their polarity or are supplied with a stepwise changing induction voltage in order to avoid segregation and liquation in the center of the cast strand.

This conventional stirring provision requires its own control circuit for switching on and off or for changing polarity or, respectively, for changing the induction voltage in order to achieve a discontinuous metal flow.

SUMMARY OF THE INVENTION

1. Purposes of the Invention

It is an object of the present invention to furnish a stirring provision for a continuous casting plant, which allows a discontinuous stirring and thus a continuous change in the metal flow in the strand.

It is another object of the invention to provide a stirring provision, which avoids the formation of a continuously uniformly directed circulating current, where the stirring provision is constructed in a simple and sturdy way and without additional switching provisions.

It is a further object of the invention to provide a method for engaging the liquid metal inside the metal strand produced in a continuous casting plant in order to avoid liquation and segregation in the center.

These and other objects and advantageous of the present invention will become evident from the description which follows.

2. Brief Description of the Invention

The present invention provides a stirring provision for a continuous casting plant which comprises a casting provision continuously delivering molten metal, a mold for forming a strand of metal from the delivered molten metal, a support for the strand leaving the mold, at least two electrical coils disposed next to a path of the strand and connected to a two phase alternating current source, where each coil end is connected to its own phase wire (R, S, T, N) of the at least two phase alternating current and where the phases (R, S, T) are shifted with respect to each other by the phase angle Φ from about 0 to 180 degrees and where the current in the coils generates an electromagnetic alternating field near at least two neighboring coils in the strand where the differences of the momentary values and the differences of the directions correspond to a phase angle difference of Φ+180 degrees.

While the phase angle Φ can in principle take any value, the values under consideration for practical purposes are much more limited. At present, it appears to be most practical to employ commercial three phase current, where the phase angles are 120 degrees. In view of reducing losses during transmission, it would be preferred for three-phase current to employ a current where the phase angles range from about 115 to 125 degrees. In addition, there is a limitation in that all the angles between the phases have to add up to some multiple of an angle of 360 degrees.

At least two coils can be disposed along the path of the strand successively in the longitudinal direction of the strand. Preferably, at least three coils are provided which are connected according to a three phase current star or a three phase delta circuit and where the connections of one coil are opposite to those of the two other coils.

According to the present invention, an eddy current is induced in the molten material in the strand of cast metal. This eddy current is based largely on flow of electrons in the metal and this flow of electrons is braked by collisions with the atoms of the melt and thus the melt is dragged along with the flow of electrons. The eddy current in the metal strand is generated by a changing magnetic field produced by magnetic induction elements, which can be represented by coils located close to the strand. The magnetic induction elements generating the varying magnetic field in the metal melt are preferably excited by a varying electric current. The magnetic induction elements are to be provided of such strength that they can generate alternating magnetic fields with a maximum strength of from about 100 to 2000 Oersted in the metal and preferably with a maximum strength of from about 500 to 1500 Oersted in the metal. The resulting magnetic induction in the melt preferably has a strength of from about 0.1 to 2 Tesla and more preferred is an induction strength of from about 0.5 to 1.5 Tesla.

The frequency of the varying magnetic field can be in the range of from about 1 to 100 Hertz and it is preferably in the range of 20 to 60 Hertz. For most commercial installations the use of the commercial power grids with frequencies of from 50 to 60 Hertz appears to be a favorable choice. The changing magnetic field induces a motion of the melt, which is in part a vibration and in part a directed motion. In accordance with the present invention it is possible to subdivide the melt motion into a vibration and directed part by approximately choosing the speed change in the magnetic field such that the resulting acceleration forces result in either a predominant vibration or a predominant directed motion.

Crystal nuclei and small crystals are generated during the cooling of the metal melt inside the strand shell and in particular during the initial cooling phase, and these small initial crystals have a higher melting point than crystals which appear at a later point in time. It is desirable to distribute parts of such higher melting point initial crystals throughout the molten part of the strand in order to achieve a more homogeneous distribution of the crystallization process and to obtain a more uniform strand. Thus the present method is employed to render the crystallized metal strand product more uniform and this uniformity can be controlled by selection of appropriate time-acceleration relations for the liquid parts of the metal strand with appropriate vibration and circulatory flows.

It is desirable that the speed of the melt generated by the magnetic induction elements is larger than the speed of the advancing overall metal strand. The maximum speed generated by the eddy currents can be from about 2 to 100 times the speed of the advancing strand and is preferably from about 5 to 20 times the speed of the advancing strand.

The location of the induction elements along the path of the advancing strand is not too critical and the location can range from the location of the casting mold to the lowest point of the liquid pool. A preferred location is near the output location of the strand coming out of the mold. As the freezing zone advances from the outside to the center of the strand, it is desirable that the stirring is effective over most of the volume of the strand containing liquid metal. As mentioned, the crystals initially generated have a higher melting point than later generated crystals and it takes time for them to redissolve in the melt once they are formed, since heat is needed for a redissolution. If the induction element is positioned near the output location of the mold and the microcrystals generated near the wall are broken and dispersed over the full inner liquid volume, this may be sufficient to provide for nucleation throughout the melt up to the lowest point of the liquid pool, since the first generated crystals need not dissolve in the liquid pool. However, if a redissolution occurs or if the crystals are not sufficiently dispersed, then it may be desirable to locate additional induction elements along the path of the strand, for example at about the middle position between the first encountered induction element and the lowest point of the liquid pool or after a cooling step or after a cooling provision along the strand employing for example spraying of water.

In the context of the present invention, magnetic induction elements such as coils for stirring a metal melt will be called neighboring if the element generating the field in the melt is substantially identical in its construction to a next disposed induction element, even though the magnetic field generated by the next element may be different at various times from that of the first induction element. Induction elements which are not neighboring have interposed another induction element of about equal functionality, but possibly differing momentary magnetic field output direction and output strength.

In the following, the word discontinuous flow will be employed in the sense that the speed vector of the flow elements changes relative to direction and/or size.

There is also provided a stirring method for a continuously cast strand which comprises the steps of feeding liquid metal from a supply to a continuous casting mold, withdrawing a continuous strand of metal from the casting mold, exciting an electromagnetic field with at least two coils disposed next to a path of the strand, where the momentary value differences and the differences in direction correspond to a phase angle difference of $\Phi+180$ degrees.

At least three induction elements are preferably connected in a three phase star or in a three phase triangle circuit, where one induction element is connected oppositely relative to the two other induction elements.

The phase lines provide a voltage at induction elements formed as coils, which results in an alternating magnetic field which reaches into the metal strand and there generates acceleration forces on the melt. At least two neighboring induction elements such as coils act as stirrers inside the liquid part of the metal strand based on the electromagnetic force effects and/or eddy current drag forces, where the momentary value differences and directional differences correspond to a phase angle difference of $\Phi+180$ degrees of the input.

At least three induction elements can be connected to a three phase power supply connected as a star or as a triangle, where one of the induction elements is connected oppositely versus a higher rotationally symmetrical arrangement involving the other two induction elements.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
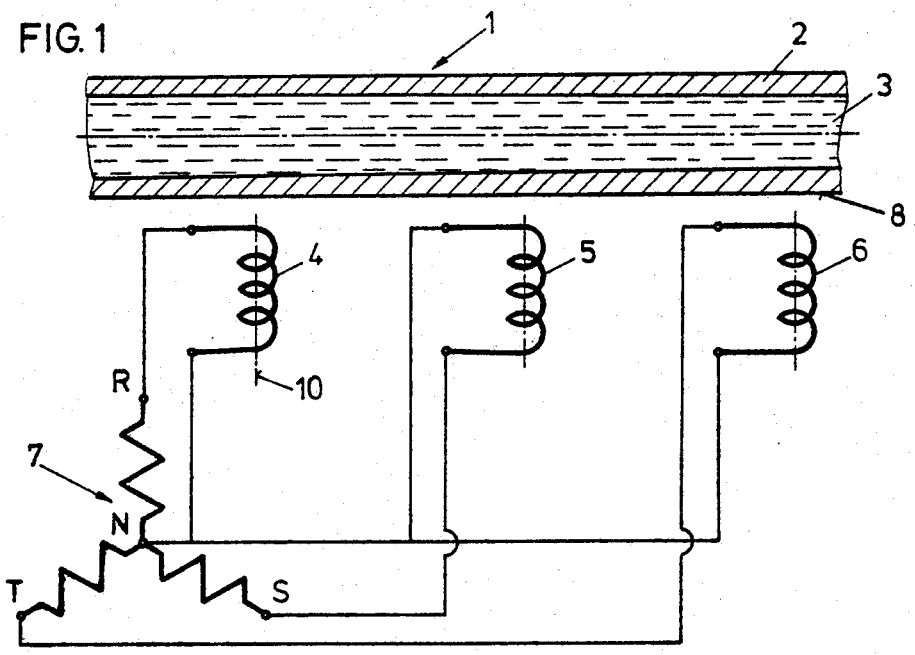
FIG. 1 is a view of a circuit diagram illustrating three induction elements disposed successively in the direction of the strand.

In accordance with the present invention there is provided a stirring provision at a continuous casting plant and in particular at a steel continuous casting plant, where at least two induction elements (4, 5, 6; 4', 5', 6'), operated with alternating current are disposed at a strand guide and are disposed successively in the longitudinal direction 11 of the strand. Each magnetic induction element 4 to 6' is connected to one phase (R, S, T, N) of the at least two phase alternating current. The phases (R, S, T) are shifted with respect to each other by a phase angle of which is between 0 degrees and 180 degrees. The phase (R, S, T, N) form a magnetic alternating field, and they cause near at least two neighboring induction elements 4 to 6' in each case at the metal flow forces, where the momentary value differences and the directional differences of the forces correspond to a phase angle difference of $\Phi+180$ degrees.

The current for an induction element coil can be provided by a star or a delta switched three phase alternating current and one induction element 5, 5' can be switched oppositely relative to the other induction elements 4, 6; 4', 6'.

Referring now to FIG. 1 there are shown three successively disposed induction elements in the longitudinal direction of one strand 1 continuously cast in a continuous casting plant. The shell of the strand 1 is designated with 2 and the liquid core of the strand is designated with 3. Possibly the induction elements are provided as cores or yokes. These induction elements 4, 5, 6 act as stirrers of the melt and are provided along the strand guide of a continuous casting plant not shown here. If the coils are disposed with an axis vertical to the direction of the advancing strand and if the magnetic field direction inside the strand is substantially vertical to the direction of the advancing strand, then some of the melt motion has a component in the direction of the advancing strand and some of the melt is moving in opposite direction to the advance direction of the strand. Furthermore, there is an eddy current component which moves the melt in a lateral direction past the axis of the strand, whereas a rotation of the melt around the center axis appears to be less pronounced.

A three phase power supply line 7 serves to power the coils forming magnetic induction elements 4, 5, 6, where the phases or, respectively, connection lines R, S, T are connected in a Y-connection. In accordance with the invention, the coils are connected as follows to the three phase power supply:

The end disposed closer to the strand is in each case connected to the R- and T- conductor from the first coil element 4 and from the last coil element 6, whereas in contrast the end of the coil element 5 disposed closer to the strand surface 8 is connected to the center point conductor N. The two ends disposed further away from the strand surface 8 of the first and last coil element 4 and 6 are connected to the center conductor N and the end of the center coil element 5 disposed further away from the strand surface 8 is connected to the S-conductor. A discontinuous magnetic alternating field is generated by the coil element 5 connected as described in opposite direction. The discontinuous alternating field interferes with the spreading of a uniform flow of the metal melt in the liquid core 3 of the strand 1 from the first to the last coil element 4 and 6. The phase shift of the three alternating current phases R, S, T amounts to about 120 degrees as is usual.

The coils elements 4 to 6 are connected to an alternating current line constructed as a delta circuit connection, where in contrast to the embodiment represented in FIG. 1 the coils are not disposed with their axes 10 vertical to the strand surface 8, but are instead disposed in parallel to the strand axis, in parallel to the axis 11 or, respectively, in parallel to the longitudinal direction of the strand and the guiding system for the strand. Here again the center coil element 5 is connected opposite to the two other coils element 4 and 6, such that again no travelling field can be generated propagating continuously over three coils, but instead a discontinuous magnetic alternating field is generated. Soft magnetic materials similar to those employed in transformers can be used to feed the alternating magnetic field to the liquid part of the advancing strand. If the direction of the magnetic induction in the melt is substantially in parallel to the direction of the advancing strand then the acceleration of the melt will have more of a circulatory motion direction around the axis of the strand. It is noted that a distribution of broken microcrystal pieces throughout the melt is achieved more effectively where the magnetic field direction in the liquid melt is vertical to the advance direction of the strand.

Figure 2:
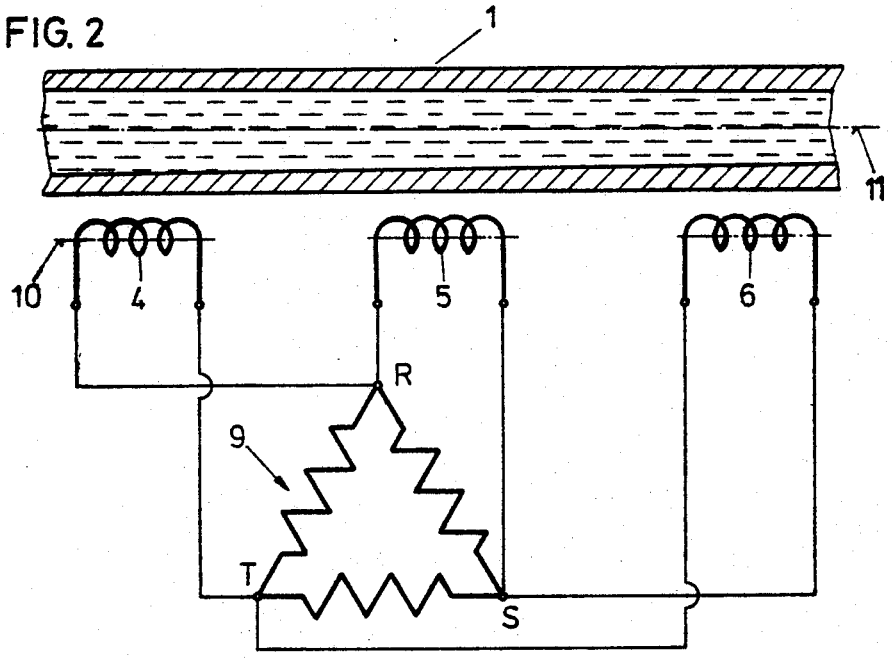
FIG. 2 is a view of a second embodiment shown in an analogous manner.

The frequency of the alternating current of the embodiments represented in FIGS. 1 and 2 are advantageously between 2 and 120 Hertz and more preferably from about 30 to 60 Hertz.

Figure 3:
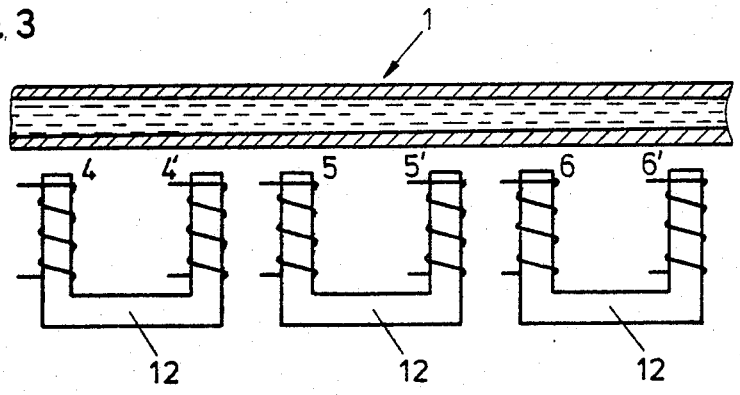
FIG. 3 is a view of a schematic diagram illustrating the employment of magnetic yokes.
Figure 4:
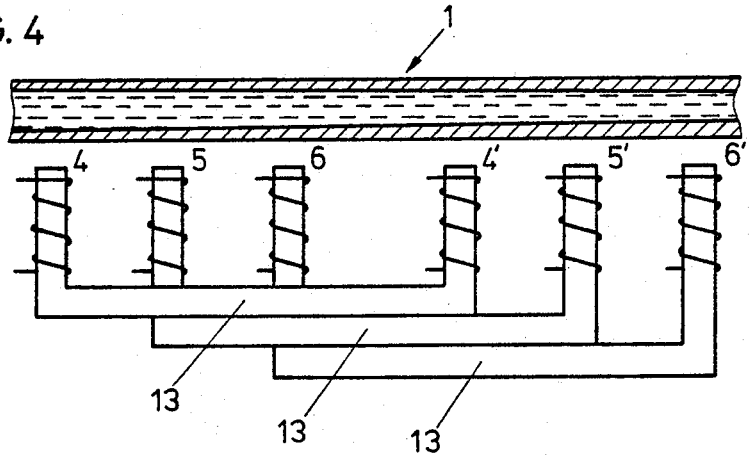
FIG. 4 is a view of a further schematic diagram illustrating a second embodiment employing yokes.
Figure 5:
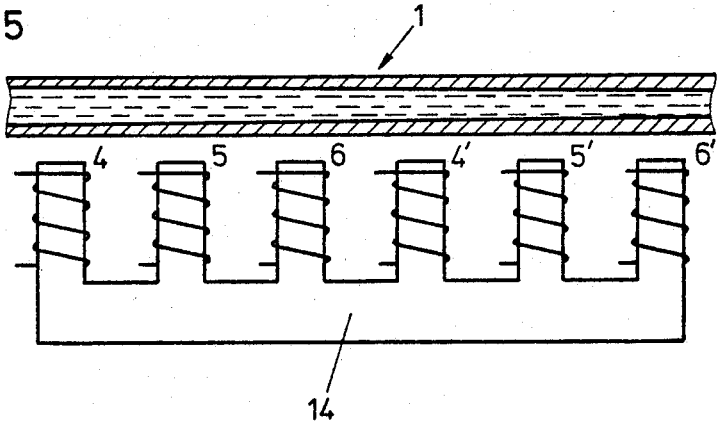
FIG. 5 is a view of a third schematic diagram illustrating a third embodiment employing yokes.

The FIGS. 3, 4, and 5 illustrate embodiments with six stirrers formed by induction elements 4, 4', 5, 5', and 6, 6', of which in each case three 4, 5, 6 and 4', 5', 6' are connected such as is shown in FIGS. 1 or 2. In each case two coils are provided with a joint yoke 12 or, respectively, 13 as illustrated in FIGS. 3 and 4. The yoke is provided of a soft magnetic material. It is a purpose of the yoke to bundle the magnetic induction into the liquid melt in the strand. Two coil elements 4, 4' or, respectively, 5, 5' and 6, 6' connected in each case in the same sense can be connected in series with in each case one phase or, respectively, one conductor R, S, T or, respectively, N, such that a group of coils is supplied by each phase or, respectively, by each conductor R, S, T, N.

All six coil elements 4 to 6' are disposed at a joint comb yoke 14 according to the embodiment of FIG. 5.

The relative motion of the metal melt relative to the shell of the strand breaks the dendrites generated at the freezing front and enters the dendrites into the liquid part of the melt because of the motion generated by the eddy current in the melt and because of the density difference of crystals and liquid part. A discontinuous concentration change at the thin layer in the transition from the liquid to the solid state cannot or can only to a slight extent occur in connection with the invention stirring provision, such that the formation of a white band is suppressed or occurs only in a minor, non-interfering way.

The favorable effects of the electromagnetic influencing of the freezing of the continuous cast metal can thus be exploited fully without having to accept the disadvantages of conventional technology providing a varied stirring intensity.

It will be understood that each of the elements described above, or two or more together, may also find a useful application in other types of freezing and casting system configurations and metal processing procedures differing from the types described above.

While the invention has been illustrated and described as embodied in the context of a stirring provision for a continuous casting plant, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stirring apparatus for a continuous casting plant comprising a casting apparatus continuously delivering molten metal;

a continuous casting mold for forming a strand of metal from the delivered molten metal;

a support for the strand leaving the mold;

at least three electric coils disposed next to a path of the strand and connected to a three phase alternating current source, where each coil end is connected to its own phase wire (R, S, T, N) of the at least three phase alternating current such that two coils are connected sequentially in phase in their power connections and one coil has its connections reversed versus a sequential symmetrical connection and where the phases (R, S, T) are shifted with respect to each other by the phase angle Φ from about 0 to 180 degrees and where the current in the coils generates an electromagnetic alternating field near at least two neighboring coils in the strand where the differences of the momentary values and the differences of the directions correspond to a phase angle difference of Φ+180 degrees.

2. The stirring apparatus for a continuous casting plant according to claim 1 wherein the at least three coils are disposed next to the path of the strand successively in the longitudinal direction of the strand.

3. The stirring apparatus for a continuous casting plant according to claim 1 wherein the at least three coils are provided which are connected according to a three phase current Y-circuit and where the connections of one coil are opposite to those of the two other coils.

4. The stirring apparatus for a continuous casting plant according to claim 1 wherein the at least three coils are connected according to a three phase current triangle circuit and where the connections of one coil are opposite to those of the two other coils.

5. The stirring apparatus for a continuous casting plant according to claim 1 wherein the magnetic induction element is disposed adjacent to the output location of the continuous casting mold in advance direction of the metal strand.

6. The stirring apparatus for a continuous casting plant according to claim 1 wherein the frequency employed for the varying electromagnetic field is from about 30 to 60 Hertz.

7. The stirring apparatus for a continuous casting plant according to claim 1 wherein the maximum field strength of the varying magnetic field at the melt in the strand is from about 500 to 1500 Oersted.

8. The stirring apparatus for a continuous casting plant according to claim 1 wherein the maximum magnetic induction of the varying magnetic field in the liquid melt pool inside the strand is from about 0.5 to 1.5 Tesla.

9. The stirring apparatus for a continuous casting plant according to claim 1 wherein the major component of the varying magnetic field vector is in a direction vertical to the local advance direction of the metal strand.

10. The stirring apparatus for a continuous casting plant according to claim 1 wherein the forces generated by the eddy currents in the metal melt are sufficient to break off initial dentrite crystal nuclei from the area near the wall of the strand and to distribute them over the liquid metal phase.

11. The stirring apparatus for a continuous casting plant according to claim 1 wherein the varying magnetic field generated in the molten melt is formed such as to generate both vibration and directed flow for the melt.

12. The stirring apparatus for a continuous casting plant according to claim 1 wherein the at least three coils are disposed adjacent to the output location of the continuous casting mold in advance direction of the metal strand;

wherein the frequency employed for the varying electromagnetic field is from about 30 to 60 Hertz;

wherein the maximum field strength of the varying magnetic field at the melt in the strand is from about 500 to 1500 Oersted;

wherein the maximum magnetic induction of the varying magnetic field in the liquid melt pool inside the strand is from about 0.5 to 1.5 Tesla; and wherein the major component of the varying magnetic field vector is in a direction vertical to the local advance direction of the metal strand.

13. The stirring apparatus for a continuous casting plant according to claim 19 wherein the forces generated by the eddy currents in the metal melt are sufficient to break off initial dentrite crystal nuclei from the area near the wall of the strand and to distribute them over the liquid metal phase; and wherein the varying magnetic field generated in the molten melt is formed such as to generate both vibration and directed flow for the melt.

14. A stirring method for a continuously cast strand comprising feeding liquid metal from a supply to a continuous casting mold;

withdrawing a continuous strand of metal from the casting mold;

exciting an electromagnetic field with at least three coils disposed next to a path of the strand, where each coil end is connected to its own phase wire (R, S, T, N) of the at least three phase alternating current such that two coils are connected sequentially in phase in their power connections and one coil has its connections reversed versus a sequential symmetrical connection for generating a resulting field in the melt.

15. The stirring method for a continuously cast strand according to claim 14 further comprising connecting said at least three coils in a three phase Y-circuit, where one coil is connected oppositely relative to the two other coils.

16. The stirring method for a continuously cast strand according to claim 14 further comprising connecting said at least three coils in a three phase triangular circuit, where one coil is connected oppositely relative to the two other coils.

17. The stirring method for a continuously cast strand according to claim 14 wherein the at least three coils are disposed adjacent to the output location of the continuous casting mold in advance direction of the metal strand.

18. The stirring method for a continuously cast strand according to claim 14 wherein the frequency employed for the varying electromagnetic field is from about 30 to 60 Hertz.

19. The stirring method for a continuously cast strand according to claim 14 wherein the maximum field strength of the varying magnetic field at the melt in the strand is from about 500 to 1500 Oersted.

20. The stirring method for a continuously cast strand according to claim 14 wherein the maximum magnetic induction of the varying magnetic field in the liquid melt pool inside the strand is from about 0.5 to 1.5 Tesla.

21. The stirring method for a continuously cast strand according to claim 14 wherein the forces generated by the eddy currents in the metal melt are sufficient to break off initial dentrite crystal nuclei from the area near the wall of the strand and to distribute them over the liquid metal phase.

22. The stirring method for a continuously cast strand according to claim 12 wherein the major component of the varying magnetic field vector is in a direction vertical to the local advance direction of the metal strand.

23. A stirring apparatus for a continuous casting plant comprising a casting apparatus continuously delivering molten metal;

a mold for forming a strand of metal from the delivered molten metal;

a support for the strand leaving the mold;

at least three electric coils disposed next to a path of the strand and connected to a three phase alternating current source, where each coil end is connected to its own phase wire (R, S, T, N) of the at least three phase alternating current such that two coils are connected sequentially in phase in their power connections and one coil has its connections reversed versus a sequential symmetrical connection.

* * * * *